United States Patent [19]

Conn et al.

[11] 3,974,604

[45] Aug. 17, 1976

[54] EASY ANCHOR

[76] Inventors: John L. Conn; George Spector, both of 3615 Woolworth Bldg., 233 Broadway, New York, N.Y. 10007

[22] Filed: Sept. 25, 1974

[21] Appl. No.: 509,081

[52] U.S. Cl. ..... 52/160; 61/53.68

[51] Int. Cl.[2] ..... E02D 5/74

[58] Field of Search ..... 61/53.68; 52/160, 159, 52/155, 156, 161

[56] References Cited

UNITED STATES PATENTS

| | | | |
|---|---|---|---|
| 373,621 | 11/1887 | Turnberger | 52/160 X |
| 958,127 | 5/1910 | Hovrud | 52/160 |
| 1,426,044 | 8/1922 | Clum | 52/155 |
| 2,468,729 | 5/1944 | Black | 52/155 |
| 2,958,404 | 11/1960 | Smith | 52/160 |

*Primary Examiner*—Jacob Shapiro

[57] ABSTRACT

An improved anchoring post for being driven to a ground, and which is particularly suitable to secure structures against being blown away in a wind; the device consisting of a tubular outer member which is first driven into a ground, and an inner member which is thereafter inserted into the outer member being slit into a series of tongues which spread out sideward within the ground so to give greater resistance against being pulled out.

1 Claim, 4 Drawing Figures

22
19
21
12
10
15
17
16
20
2
11
13
14
23
18
28
31
30
24
27
25
26
29
4

EASY ANCHOR

This invention relates generally to anchoring posts that are driven into a ground.

A principle object of the present invention is to provide an improved easy anchor which has a greater resistance strength from being pulled out after being driven in a ground.

Another object is to provide an easy anchor which is particularly suitable to secure structures such as mobile homes and other constructions that are subject to be moved by hurricanes or high winds.

Other objects are to provide an easy anchor which is simple in design, inexpensive to manufacture, rugged in construction, easy to use and efficient in operation.

These and other objects will be readily evident upon a study of the following specification and the accompanying drawing wherein.

Figures 1, 2, 3, 4:
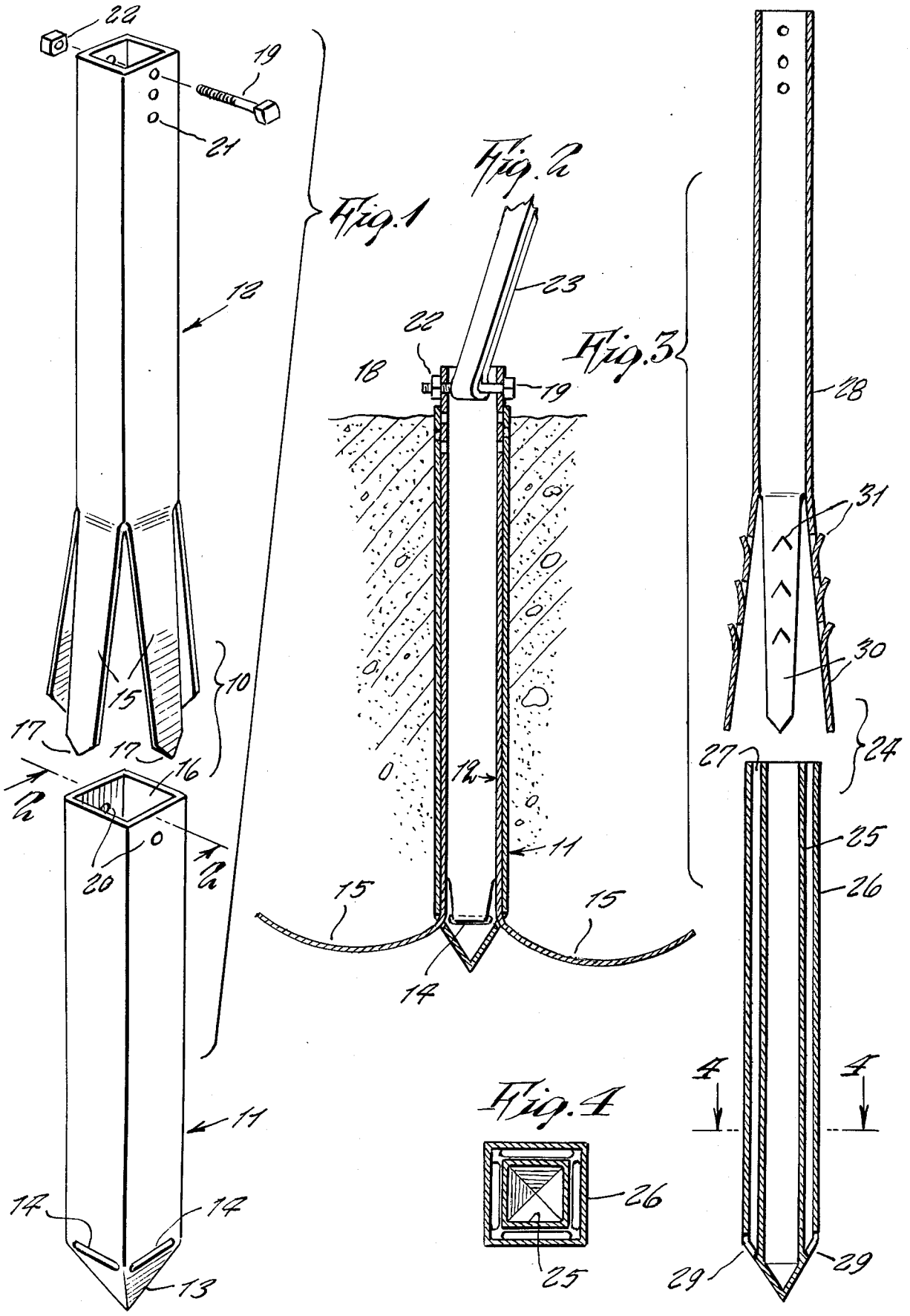
FIG. 1 is a perspective view of the components of the easy anchor invention shown in position ready for assembly together.
FIG. 2 is a cross sectional view on line 2—2 of FIG. 1 and showing the components assembled and in operative use in a ground.
FIG. 3 is a cross section of a modified design of the invention in which the outer sleeve also includes an inner sleeve between which the tongues of the tongued member is slidable so to prevent the tongues from buckling inside the outer sleeve in case the tongue tips meets a hard or rocky ground, and each tongue additionally having spurs to prevent them from being pulled from out of the ground.
FIG. 4 is an enlarged cross section view on line 4—4 of FIG. 3.

Referring now to the drawing in detail, and more particularly to FIGS. 1 and 2 thereof, at this time, the reference numeral 10 represents an easy anchor according to the present invention wherein there is a hollow outer post 11 adaptable to receive an inner post 12. Each post is made of cross-sectionally square tubular metal.

The upper end of the outer post is left open so to allow the inner post to be inserted thereinto. The lower end of the outer post is tapered to a point 13 which is of inverted pyramid shape, and a slot 14 is formed on all four sides at the junction between the tapered point and the post side walls. The outer post is first pounded down into the ground, when installing an easy anchor.

The inner post 12 is likewise left open at its upper end, while the lower end thereof is formed with a longitudinally extending tongue 15 on all four sides. The tongues may be made to spread apart slightly, when relaxed, as shown in FIG. 1, but which may be forced toward each other (due to a springiness in the metal) so that, in use, they may be readily entered into the central opening 16 of the outer post, and so that a tapered point 17 on each tongue 15 slides in contact with the outer post inner wall whereby the points 17 find the slots 14 so to pass outwardly therethrough and enter the ground 18, as the upper end of the inner post is pounded down. As the tongues enter the ground, they will tend to flare out as shown in FIG. 2, thus giving a wide spread hold underground beneath a greater mass of earth.

It is to be noted that the both post square portions are equal in length so that when the inner post is nearly fully down inside the outer post, the tongues are nearly completely extended from the slots. When the inner post is pounded fully down, a bolt 19 is then inserted through openings 22 (FIG. 2) or through an opening 20 of the outer post and through any openings 21 of the inner post that align with openings 21 (not shown). A nut 22 is then threaded on the bolt.

A strap 23 is then secured around a center of the bolt and is attachable to any structure that is intended to be anchored.

In FIGS. 3 and 4, a modified design of easy anchor 24 is shown to include an inner sleeve 25 inside the outer post 26, with a space 27 therebetween into which the inner post 28 is slidable. The sleeve 25 is secured to the outer post at one end only, and the slots 29 for receiving tongues 30 are within the end of the space 27.

The tongues 30 in this form of the invention include spurs 31 that prevent the tongues to be withdrawn in reverse direction through the slots.

In this form of the invention, the inner sleeve prevents the tongues to collapse inside the outer post in case the tongues encounter stubborn ground.

Thus a modified design of the invention is provided.

While various changes may be made in the detail construction, it is understood that such changes will be within the spirit and scope of the present invention as is defined by the appended claims.

What is claimed is:

1. In an easy anchor, the combination of a hollow outer post, and a hollow inner post snugly slidable into said outer post, each said post being of similar cross sectional configuration, the upper ends thereof being left open, a lower end of said outer post being tapered to a point of inverted pyramid shape including transverse slots provided at the beginning of the tapered portion of said lower end, said inner post having resilient tongues at its lower end aligned with said slots for sliding and bending outwardly through said slot when said inner post is pushed inside said outer post, said tongues normally spreading slightly when in a relaxed position, each said tongue having a tapered point, the portion of the inner post above the tongues being of the same length as the untapered portion of the outer post, said upper ends of said posts having a plurality of transverse openings for alignment so to receive a transverse bolt and lock nut, including a strap being passed around a center of said bolt, said strap serving for attachment to any structure that is intended to be secured against a high wind, wherein an inner sleeve is affixed within the spaced from said outer post, said sleeve being secured at its lower end to said post and having same cross sectional shape as said posts, wherein the inner post being dimensioned to fit snugly and slidably between said outer post and sleeve, said slots being formed between said outer post and said sleeve, including upwardly disposed bent-out spurs extending from said tongues to resist removal of said inner post.

* * * * *